US008136375B2

(12) United States Patent
Shen

(10) Patent No.: US 8,136,375 B2
(45) Date of Patent: Mar. 20, 2012

(54) DOOR LOCK FOR USE WITH DIFFERING INTERCHANGEABLE LOCK CORES

(75) Inventor: Mu-Lin Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 100 days.

(21) Appl. No.: 12/763,259

(22) Filed: Apr. 20, 2010

(65) Prior Publication Data

US 2011/0252841 A1 Oct. 20, 2011

(51) Int. Cl.
*E05B 65/00* (2006.01)

(52) U.S. Cl. ..... 70/91; 70/224; 70/367; 70/370; 70/371

(58) Field of Classification Search ..... 70/367–371, 70/379 R–380, 224; 292/336.3, 347, 348
See application file for complete search history.

(56) References Cited

U.S. PATENT DOCUMENTS 5,398,531 A * 3/1995 Shen ..... 70/224
6,109,080 A * 8/2000 Chen et al. ..... 70/371
6,640,593 B1 * 11/2003 Hannah et al. ..... 70/224
6,935,149 B1 * 8/2005 Peng et al. ..... 70/472
7,047,775 B2 * 5/2006 Huang ..... 70/224
2002/0189305 A1 * 12/2002 Shen ..... 70/224
2006/0086162 A1 * 4/2006 Huang ..... 70/224
2008/0012361 A1 * 1/2008 Sun et al. ..... 292/347

* cited by examiner

*Primary Examiner* — Suzanne Barrett
*Assistant Examiner* — Ifeolu Adeboyejo
(74) *Attorney, Agent, or Firm* — Alan Kamrath; Kamrath IP Lawfirm, PA

(57) ABSTRACT

A door lock includes an engaging member having a lock core hole. The lock core hole includes a large section and a small section. The large section is formed in an end of the engaging member that is detachably received in a shank of an outer handle. An interchangeable lock core is removably received in the large section. An end of an outer spindle is extended out of a lock body of the door lock and is detachably received in the small section of the lock core hole of the engaging member. The lock core has an outline corresponding to the large section of the engaging member. The lock core can be removed and replaced with a new one. The engaging member can be detached from the outer spindle and the outer handle and replaced with a new engaging member corresponding to the outline of the new lock core.

7 Claims, 7 Drawing Sheets

DOOR LOCK FOR USE WITH DIFFERING INTERCHANGEABLE LOCK CORES

BACKGROUND OF THE INVENTION

The present invention relates to a door lock with an interchangeable lock core and, more particularly, to a door lock that can be used with differing interchangeable lock cores.

Door locks with an interchangeable lock core allow replacement of the lock core when the lock core is damaged or when the key is lost or for other reasons. Substantially figure 8-shaped interchangeable lock cores have been developed to allow easy replacement by the user through simple operation. However, lock cores have differing shapes, sizes, and types such that the lock cores of a manufacturer can not replace those of another manufacturer.

Thus, a need exists for a door lock that can be used with differing interchange lock cores of differing shapes and sizes.

BRIEF SUMMARY OF THE INVENTION

The present invention solves this need and other problems in the field of convenient use of interchangeable lock cores by providing, in a preferred form, a lock body adapted to be mounted in a door. An outer spindle includes an end extending beyond the lock body. The end of the outer spindle is adapted to extend beyond an outer side of the door. The end of the outer spindle includes a first cutout. A latch is operably connected to the outer spindle to move between an extended, latching position and a retracted, unlatching position. An engaging member is detachably mounted to the outer spindle. The engaging member includes first and second ends spaced along an axis. A sleeve extends away from an end face of the first end of the engaging member along the axis. A lock core hole extends from the second end of the engaging member through the sleeve along the axis. The lock core hole includes a large section in the second end of the engaging member. The large section has an end wall. An ear groove is defined in an inner periphery of the larger section. The lock core hole further includes a small section extending through the sleeve into the first end of the engaging member and having a bottom wall spaced from the end wall of the large section along the axis. The lock core hole further includes an intermediate section in communication with and intermediate the small and large sections. The intermediate section extends between the end wall of the large section and the bottom wall of the small section. The large section is substantially figure 8-shaped and includes a first hole and a second hole in communication with the first hole. The first hole is aligned with the small section of the engaging member along the axis and has an inner diameter smaller than that of the small section. A first lug is formed on an inner periphery of the intermediate section. The outer spindle is removably received in the small section with the first lug engaged in the first cutout and with the end of the outer spindle abutting the bottom wall of the small section, allowing joint rotation of the engaging member and the outer spindle. An outer handle includes a stem having outer and inner sides spaced along the axis. A shank is formed on the inner side of the stem and has a distal end spaced from the inner side along the axis. A coupling hole is defined in the shank and has a shape complementary to the engaging member. The coupling hole includes an inner opening in the distal end. An outer opening is formed in the outer side of the stem and extends through the coupling hole along the axis. The outer opening is aligned with the inner opening along the axis. The engaging member is releasably engaged in the coupling hole of the shank but not rotatable relative to the shank. The sleeve extends beyond the shank via the inner opening. A lock core has an outline complementary to the large section of the lock core hole of the engaging member. A cylinder is pivotably received in the lock core. The cylinder includes an ear movable between an extended position outside of the lock core and engaged in the ear groove of the engaging member and a retracted position inside the lock core and disengaged from the ear groove. The lock core is removable from the large section of the lock core hole of the engaging member along the axis when the ear is in the retracted position.

In the most preferred form, the sleeve has an outer diameter smaller than a maximum width of the engaging member perpendicular to the axis. The engaging member includes a positioning groove formed in an outer periphery thereof. The positioning groove extends from an end face of the second end towards but spaced from the first end of the engaging member. The positioning groove has an end face intermediate the first and second ends of the engaging member along the axis. A through-hole extends from the end face of the positioning groove through the end face of the first end of the engaging member along the axis. A positioning block is formed on an inner periphery of the coupling hole of the shank and engaged in the positioning groove. A fastener is extended through the through-hole into the positioning block. The engaging member is removable from the outer handle after removal of the fastener.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
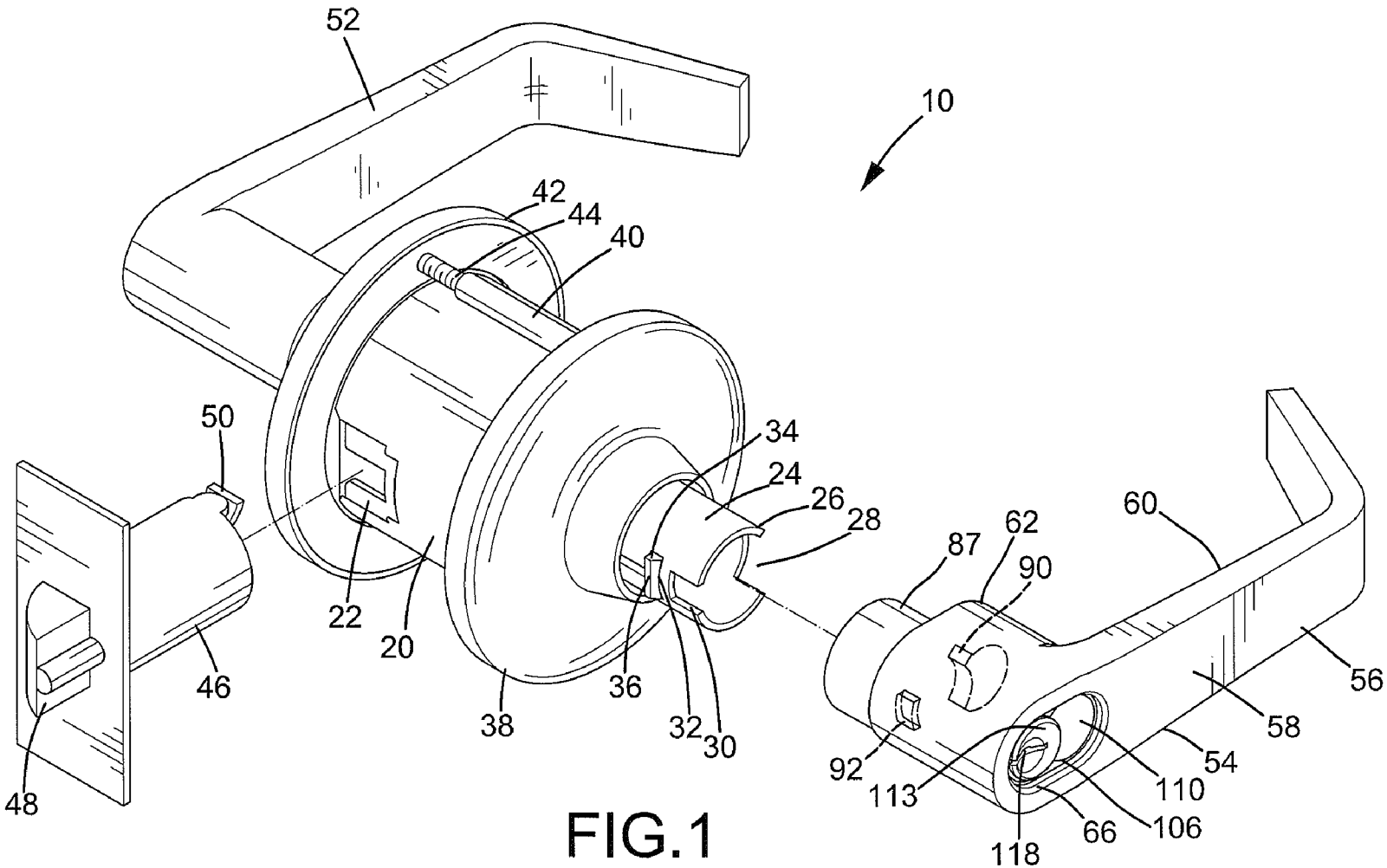
FIG. 1 shows an exploded, perspective view of a door lock according to the preferred teachings of the present invention.
Figure 2:
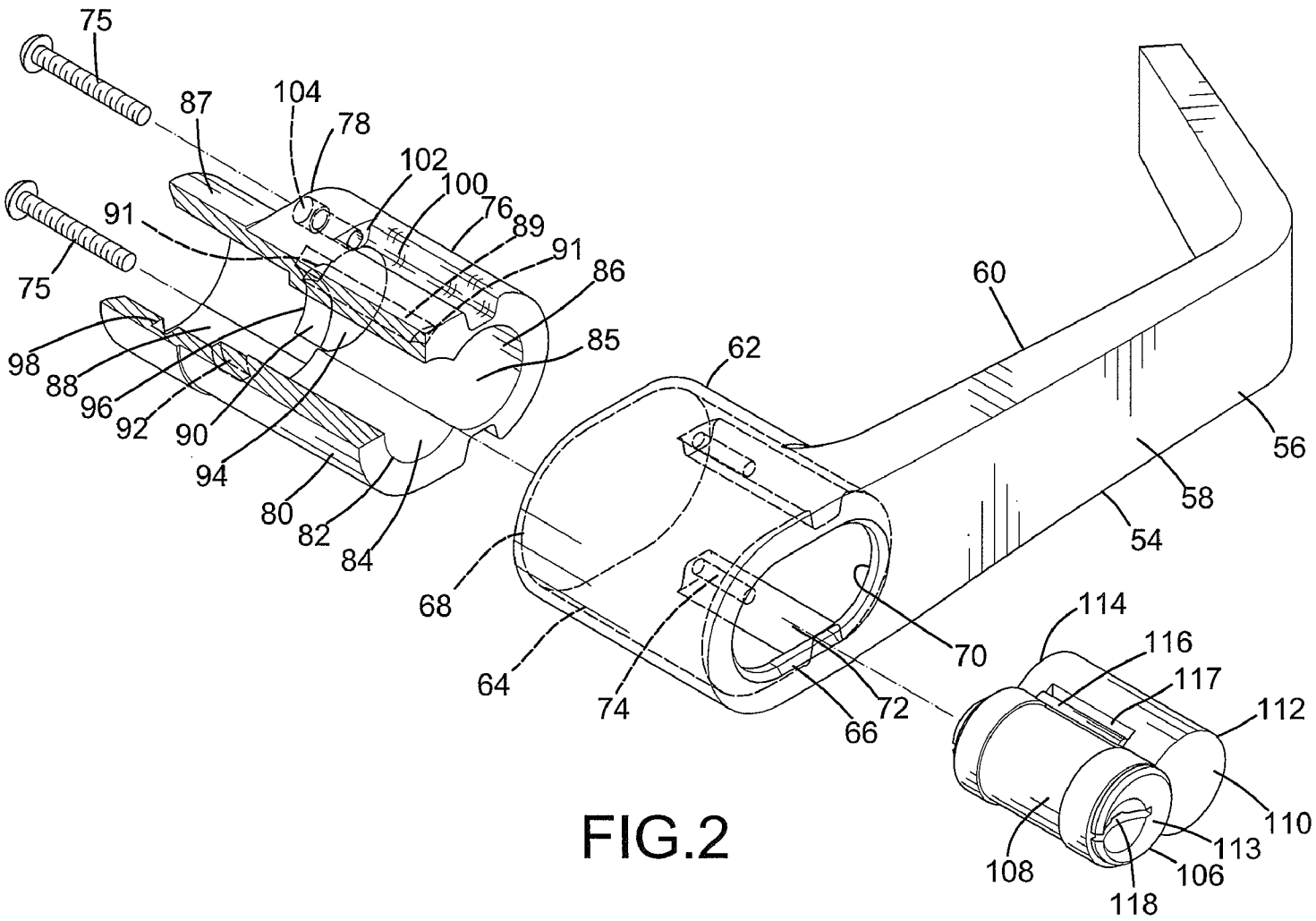
FIG. 2 shows a partial, exploded, perspective view of the door lock of FIG. 1.
Figure 3:
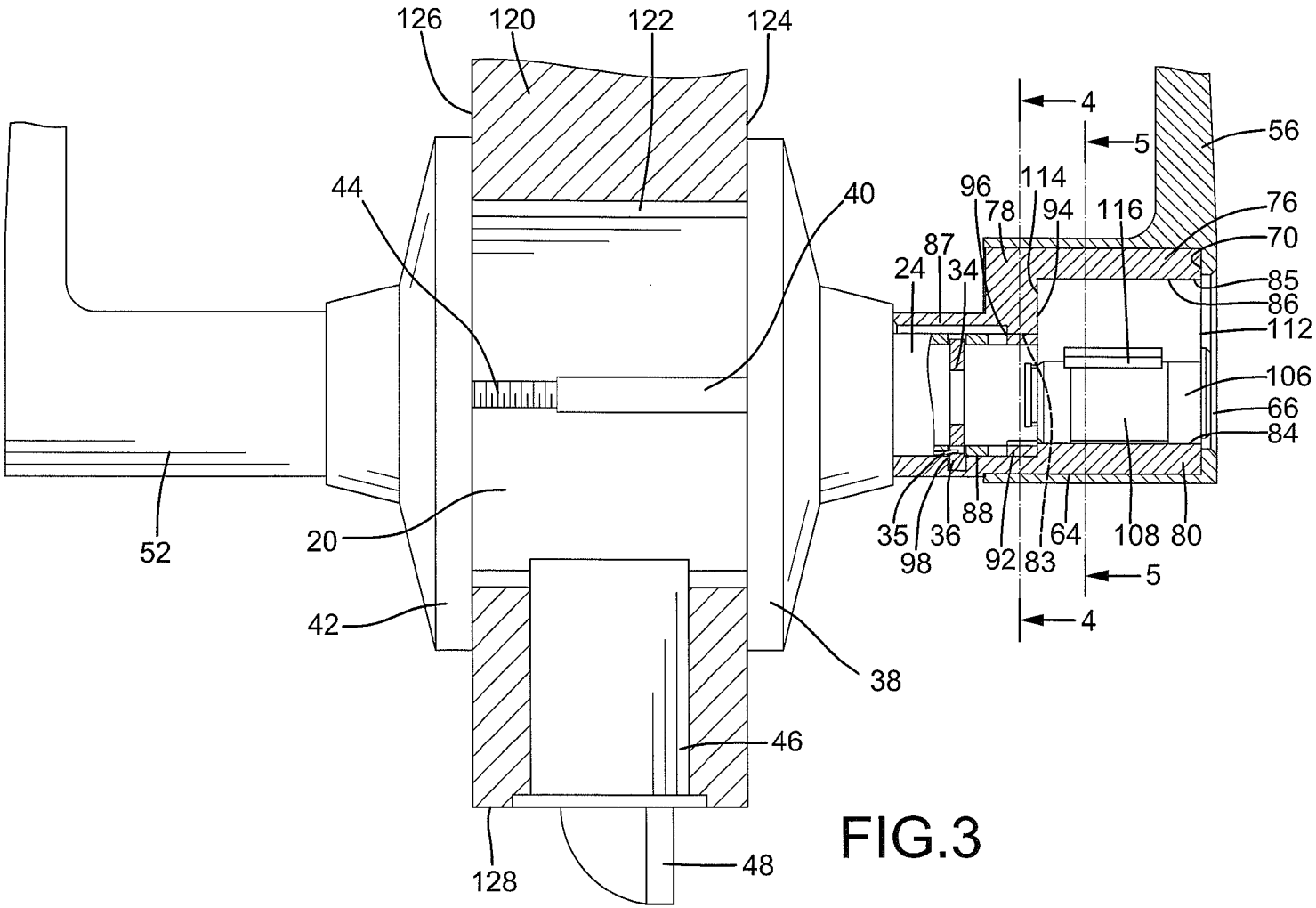
FIG. 3 shows a partially cross-sectioned view of the door lock of FIG. 1 mounted to a door.
Figure 4:
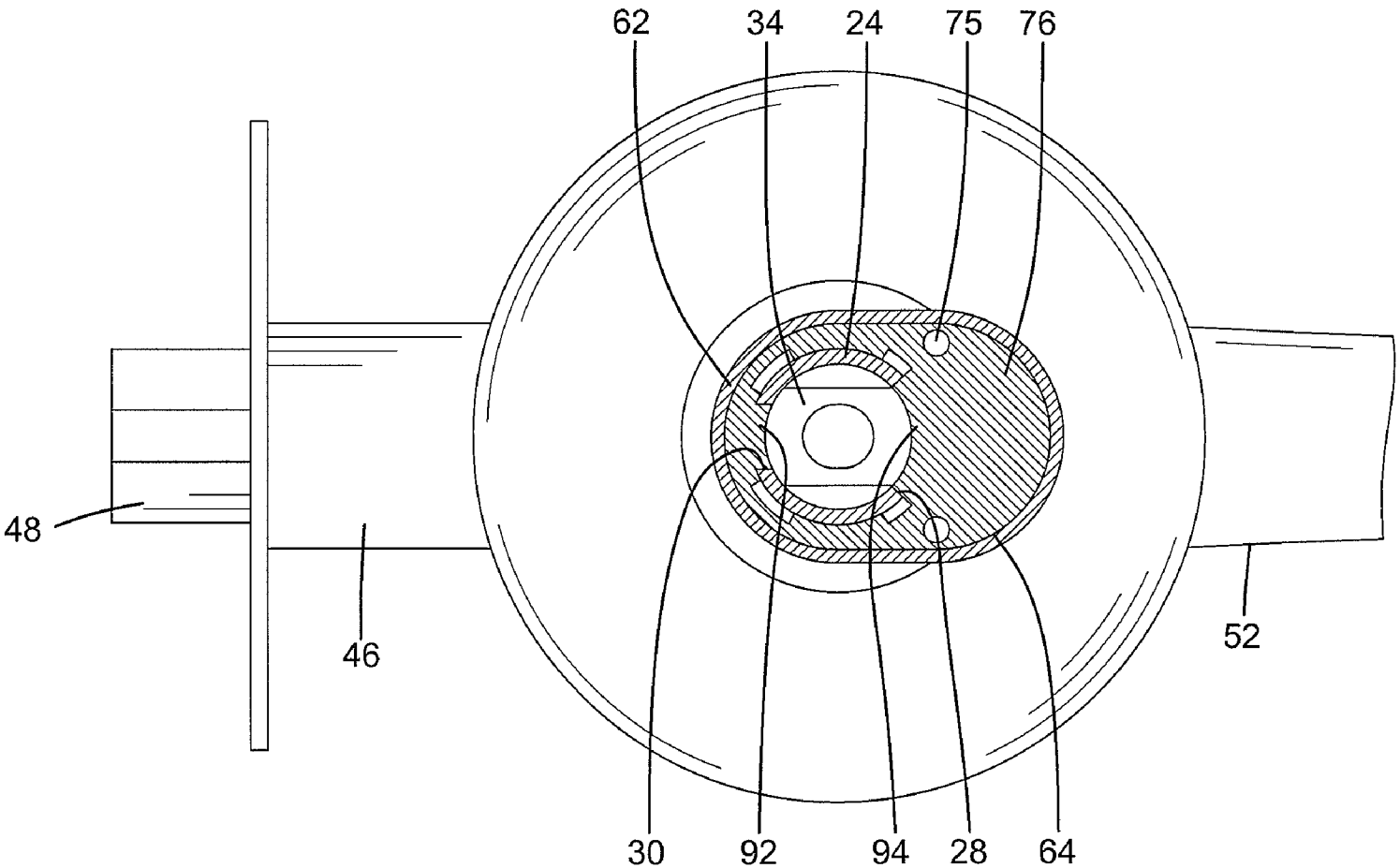
FIG. 4 shows a cross sectional view taken along section line 4-4 of FIG. 3.
Figure 5:
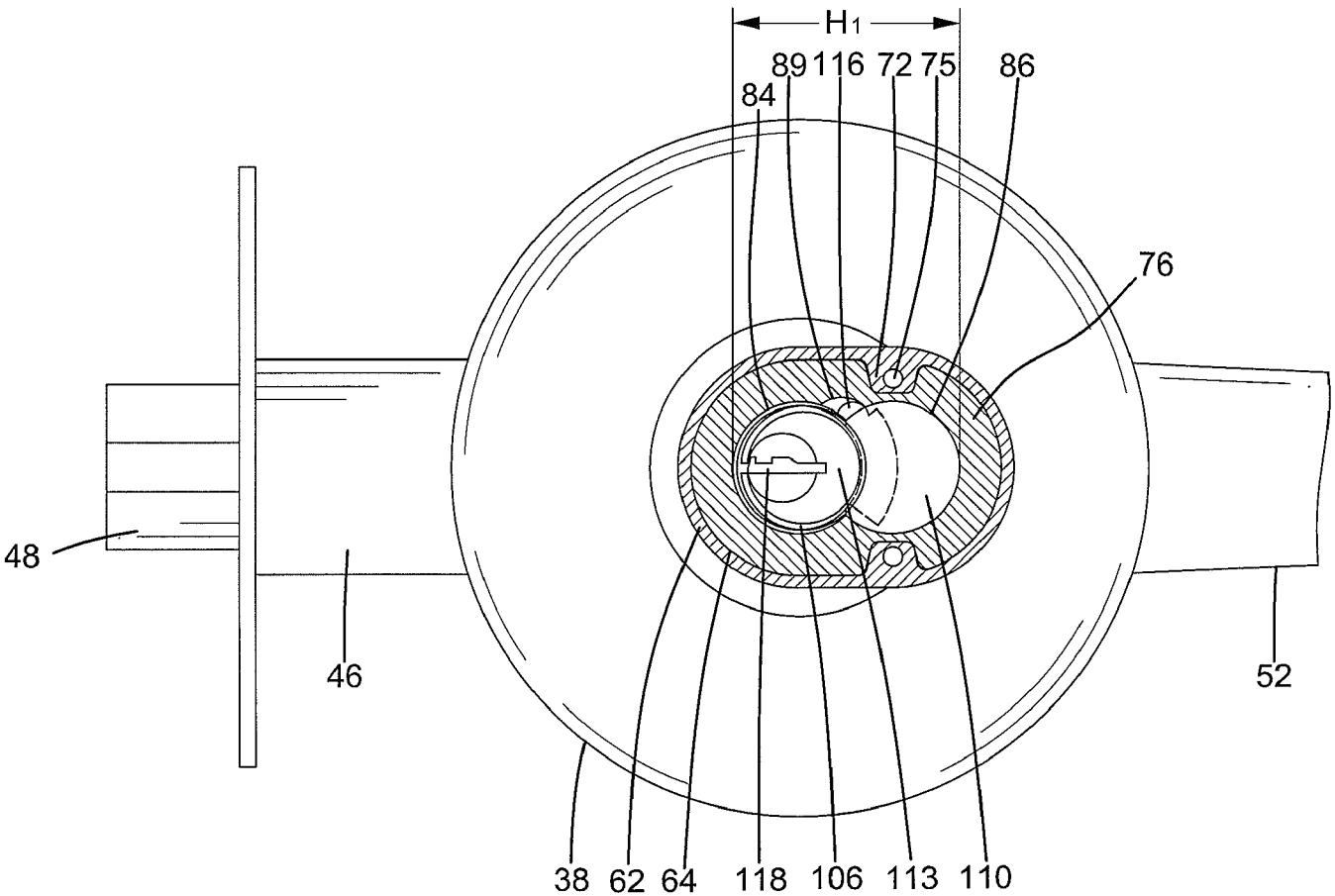
FIG. 5 shows a cross sectional view taken along section line 5-5 of FIG. 4.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "section", "longitudinal", "axial", "radial", "circumferential", "annular", "inward", "outward", "clockwise", "counterclockwise", "length", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A door lock according to the preferred teachings of the present invention is shown in the drawings and generally designated 10. According to the preferred form shown, door lock 10 includes a lock body 20 receiving a retractor 22. Inner and outer escutcheons 42 and 38 are mounted on opposite ends of lock body 20 and spaced along a first axis. Two mounting posts 40 extend from outer escutcheon 38 along the first axis. Two screws 44 extend from inner escutcheon 42 into screw holes in mounting posts 40. Lock body 20 further includes an inner spindle coupled to an inner handle 52. Lock body 20 further includes an outer spindle 24 having an end 26 extending out of outer escutcheon 38. End 26 includes first and second cutouts 28 and 30 spaced along a circumferential direction about the first axis. In the most preferred form shown, first and second cutouts 28 and 30 are aligned along a second axis perpendicular to the first axis. Outer spindle 24 further includes an insert slot 32 aligned with and spaced from second cutout 30 along the first axis. An insert 34 is received in outer spindle 24 and biased by a resilient member 35 such that a portion 36 of insert 34 can protrude outward in a radial direction perpendicular to the first axis beyond insert slot 32. Outer spindle 24 is operably connected to retractor 22.

According to the preferred form shown, lock body 20 is mounted in a mounting hole 122 in a door 120 with outer escutcheon 38 abutting an outer side 124 of door 120 and with inner escutcheon 42 abutting an inner side 126 of door 120. Screws 44 are tightly engaged with mounting posts 40 so that inner and outer sides 126 and 124 of door 120 are securely sandwiched between inner and outer escutcheons 42 and 38.

According to the preferred form shown, door lock 10 further includes a latch device 46 including a latch 48 mounted to an end face 128 of door 120. Latch 48 has a tail 50 engaged with retractor 22 such that movement of retractor 22 through rotation of the inner spindle or outer spindle 24 causes retraction of latch 48 from an extended, latching position to a retracted, unlatching position.

According to the preferred form shown, door lock 10 further includes an engaging member 76 that is non-circular in cross section. Engaging member 76 includes first and second ends 78 and 80 spaced along the first axis. A sleeve 87 extends away from an end face of first end 78 of engaging member 76 along the first axis and has an outer diameter smaller than a maximum width of engaging member 76 perpendicular to the first axis. A lock core hole 82 extends from second end 80 of engaging member 76 through sleeve 87 along the first axis. Lock core hole 82 includes a large section 85 in second end 80. Lock core hole 82 further includes a small section 88 extending through sleeve 87 into first end 78 and having a bottom wall 96 spaced from an end wall 94 of large section 85 along the first axis. Lock core hole 82 further includes an intermediate section 83 in communication with and intermediate small and large sections 88 and 85. Intermediate section 83 extends between end wall 94 of large section 85 and bottom wall 96 of small section 88. Large section 85 is substantially figure 8-shaped and includes a first hole 84 and a second hole 86 in communication with first hole 84. First hole 84 is aligned with small section 88 along the first axis and has an inner diameter smaller than that of small section 88. End wall 94 is located in an end of second hole 86 in the most preferred form shown. An ear groove 89 is defined in a junction between an inner periphery of first hole 84 and an inner periphery of second hole 86. Ear groove 89 includes two end faces 91 spaced along the first axis. End faces 91 are parallel to each other and are perpendicular to the first axis in the most preferred form shown. An inner periphery of small section 88 includes an insert groove 98 spaced from bottom wall 96 of small section 88 along the first axis. A first lug 90 is formed on an inner periphery of intermediate section 83 extending between end wall 94 of large section 85 and bottom wall 96 of small section 88. A second lug 92 is formed on the inner periphery of intermediate section 83 and diametrically opposed to first lug 90. Second lug 92 is aligned with and spaced from insert groove 98 along the first axis. Two positioning grooves 100 are formed in an outer periphery of engaging member 76 and each extend from an end face of second end 80 towards but spaced from first end 78. Each positioning groove 100 has an end face 102 intermediate first and second ends 78 and 80 of engaging member 76 along the first axis. A through-hole 104 extends from end face 102 of each positioning groove 100 through the end face of first end 78 of engaging member 76 along the first axis.

According to the preferred form shown, door lock 10 further includes an outer handle 54 having a stem 56 with outer and inner sides 58 and 60 spaced along the first axis. A shank 62 is formed on an end of inner side 60 of stem 56 and has a distal end. Inner side 60 of stem 56 is intermediate outer side 58 of stem 56 and distal end of shank 62 along the first axis. A coupling hole 64 is defined in shank 62 and has a shape complementary to engaging member 76. Coupling hole 64 includes an inner opening 68 in the distal end. An outer opening 66 is formed in outer side 58 of stem 56 and extended through coupling hole 64 along the first axis. Outer opening 66 is aligned with outer opening 68 along the first axis and has a cross sectional area perpendicular to the first axis smaller than that of coupling hole 64 perpendicular to the first axis, forming a stop face 70 at intersection between coupling hole 64 and outer opening 66. The cross sectional area of outer opening 66 is larger than and receives a lock core 106. Two positioning blocks 72 are formed on an inner periphery of coupling hole 64 and extend along the first axis. Positioning blocks 72 are aligned with and spaced from each other along a third axis perpendicular to the first and second axes in the most preferred form shown. Each positioning block 72 includes a screw hole 74 extending along the first axis.

Engaging member 76 is received in coupling hole 64 with the end face of second end 80 abutting stop face 70 and with sleeve 87 extending out of shank 62 via inner opening 68. Positioning blocks 72 are respectively engaged in positioning grooves 100 with an end of each positioning block 72 abutting end face 102 of one of positioning grooves 100. A fastener 75 is extended through each through-hole 104 into screw hole 74 of one of positioning blocks 72. Engaging member 76 can be detached from shank 62 after removing fasteners 75.

Outer spindle 24 is received in small section 88 with first lug 90 engaged in first cutout 28 and with second lug 92 engaged in second cutout 30, allowing joint rotation of outer spindle 24 and engaging member 76. End 26 of outer spindle 24 abuts bottom wall 96 of small section 88. During assembly, insert 34 is pressed radially inward into outer spindle 24 by the inner periphery of small section 88. When insert groove 98 is aligned with insert 34, protruded portion 36 of insert 34 will be engaged in insert groove 98 under the action of resilient member 35. The position of engaging member 76 along the first axis is, thus, fixed. Thus, engaging member 76 connects outer handle 54 to outer spindle 24 such that rotation of outer handle 54 causes joint rotation of outer spindle 24.

According to the preferred form shown, lock core 106 includes substantially figure 8-shaped cross sections and includes first and second portions 108 and 110 extending along the first axis. Lock core 106 further includes outer and inner ends 112 and 114 spaced along the first axis. A cylinder 113 is pivotably received in first portion 108 and includes a keyhole 118 extending along the first axis. An ear slot 117 is formed in an intersection of first and second portions 108 and 110. Cylinder 113 further includes an ear 116 movable between an extended position out of ear slot 117 and a retracted position inside ear slot 117. A lock core key can be inserted into keyhole 118 and rotated to move ear 116 between the extended position and retracted position for mounting or replacement of lock core 106. Another key can be inserted into keyhole 118 and rotated to perform locking/unlocking functions, which is conventional.

When ear 116 is in the retracted position, lock core 106 can be inserted into lock core hole 82 via outer opening 66 of outer handle 54 with first portion 108 received in first hole 84, with second portion 110 received in second hole 86, with inner end 114 of second portion 110 abutting end wall 94 of large section 85, and with ear 116 aligned with ear groove 89. By rotating the lock core key in keyhole 118 in a direction, ear 116 can be moved to the extended position into ear groove 89 and sandwiched between end faces 91, securing ear 116 in large section 85 of lock core hole 82 of engaging member 76.

When it is desired to replace lock core 106, ear 116 can be disengaged from ear groove 89 by rotating the lock core key in keyhole 118 in a reverse direction. Then, lock core 106 can be removed from engaging member 76, and a new lock core 106 can be inserted into lock core hole 82.

Figure 6:
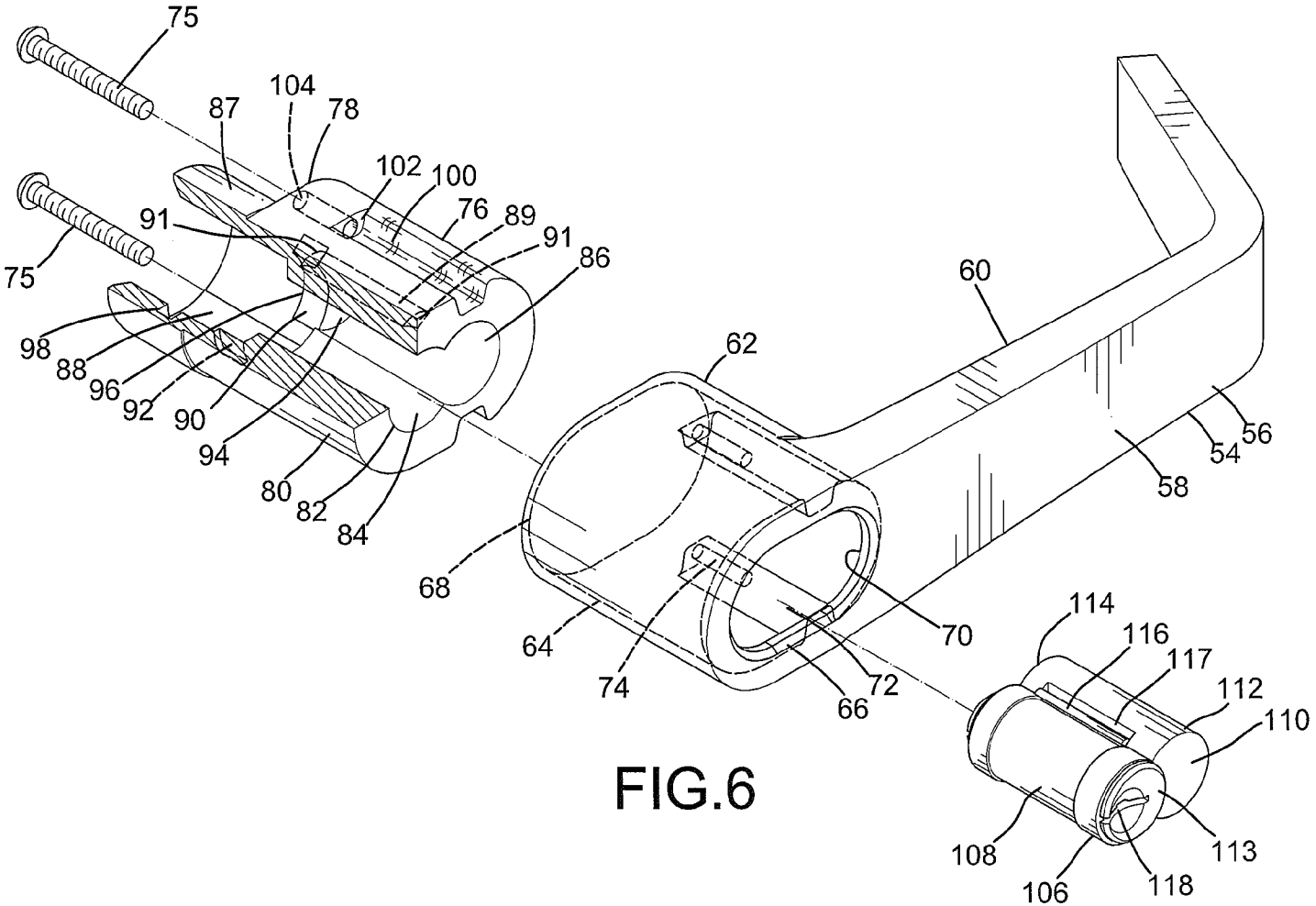
FIG. 6 shows a partial, exploded, perspective view of the door lock according to the preferred teachings of the present invention utilized with a smaller lock core.
Figure 7:
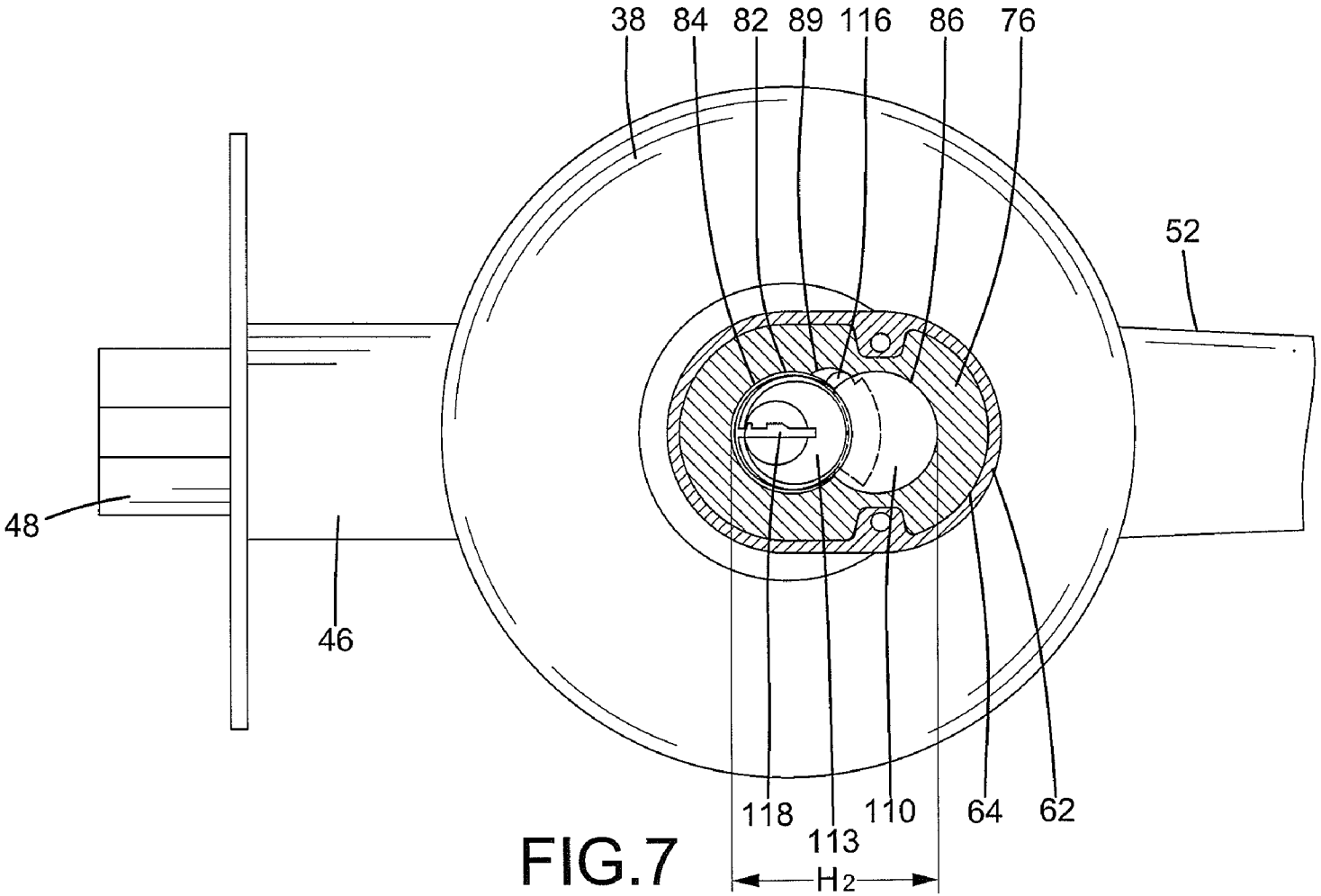
FIG. 7 shows a partially cross-sectioned view of a portion of the door lock of FIG. 6.

In a case that the new lock core 106 (having a maximum length H2, see FIGS. 6 and 7) has a size smaller than the original lock core (having a maximum length H1 larger than H2, see FIGS. 1-5) and, thus, can not be fittingly received in large section 85 of lock core hole 82 of engaging member 76, the user can remove engaging member 76 and outer handle 54 from outer spindle 24. For example, the user can press insert 34 radially inward with a screwdriver or the like to disengage insert 34 from insert groove 98 to allow removal of engaging member 76 and outer handle 54 from outer spindle 24. After removing fasteners 75, engaging member 76 can be detached from outer handle 54 and replaced with a new engaging member 76 having a lock core hole 82 with a large section 85 complementary to an outline of the new lock core 106. It is appreciated that the new engaging member 76 is substantially the same as engaging member 76 mentioned above except the size of large section 85 of lock core hole 82.

Door lock 10 according to the preferred teachings of the present invention can be used with interchangeable lock cores of differing sizes, shapes, and types made by different manufacturers through replacement of a corresponding engaging member 76 whose large section 88 is complementary to the outline of lock core 106, which is cost-saving. Coupling between engaging member 76 and outer spindle 24 is enhanced through engagement of first and second lugs 90 and 92 in first and second cutouts 28 and 30 and engagement of insert 34 in insert groove 98. Coupling between engaging member 76 and outer handle 54 is achieved by non-circular configuration and by engagement of positioning blocks 72 and positioning grooves 100, providing enhanced structural strength between engaging member 76 and outer handle 54 and avoiding damage to door lock 10 resulting from excessive force imparted to outer handle 54.

Now that the basic teachings of the present invention have been explained, many extensions and variations will be obvious to one having ordinary skill in the art. For example, engaging member 76 can include only one or even no positioning grooves 100, and outer handle 54 can include only one or even no positioning blocks 72. The number and shape of first and second lugs 90 and 92 can be varied responsive to changes in those of first and cutouts 28 and 30. As an example, end 26 of outer spindle 24 does not have to include second cutout 30, and shank 62 does not have to include second lug 92.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising:

a lock body adapted to be mounted in a door;

an outer spindle including an end extending beyond the lock body, with the end of the outer spindle adapted to extend beyond an outer side of the door, with the end of the outer spindle including a first cutout;

a latch operably connected to the outer spindle to move between an extended, latching position and a retracted, unlatching position;

an engaging member detachably mounted to the outer spindle, with the engaging member including first and second ends spaced along an axis, with a sleeve extending away from an end face of the first end of the engaging member along the axis, with a lock core hole extending from the second end of the engaging member through the sleeve along the axis, with the lock core hole including a large section in the second end of the engaging member, with the large section having an end wall, with an ear groove defined in an inner periphery of the larger section, with the lock core hole further including a small section extending through the sleeve into the first end of the engaging member and having a bottom wall spaced from the end wall of the large section along the axis, with the lock core hole further including an intermediate section in communication with and intermediate the small and large sections, with the intermediate section extending between the end wall of the large section and the bottom wall of the small section, with the large section being substantially figure 8-shaped and including a first hole and a second hole in communication with the first hole, with the first hole aligned with the small section of the engaging member along the axis and having an inner diameter smaller than that of the small section, with a first lug formed on an inner periphery of the intermediate section, with the outer spindle removably received in the small section with the first lug engaged in the first cutout and with the end of the outer spindle abutting the bottom wall of the small section, allowing joint rotation of the engaging member and the outer spindle;

an outer handle including a stem having outer and inner sides spaced along the axis, with a shank formed on the inner side of the stem and having a distal end spaced from the inner side along the axis, with a coupling hole defined in the shank and having a shape complementary to the engaging member, with the coupling hole including an inner opening in the distal end, with an outer opening being formed in the outer side of the stem and extending through the coupling hole along the axis, with the outer opening aligned with the inner opening along the axis, with the engaging member releasably engaged in the coupling hole of the shank but not rotatable relative to the shank, with the sleeve extending beyond the shank via the inner opening; and a lock core having an outline complementary to the large section of the lock core hole of the engaging member, with a cylinder pivotably received in the lock core, with the cylinder including an ear movable between an extended position outside of the lock core and engaged in the ear groove of the engaging member and a retracted position inside the lock core and disengaged from the ear groove, with the lock core being removable from the large section of the lock core hole of the engaging member along the axis when the ear is in the retracted position.

2. The door lock as claimed in claim 1, with the engaging member including a positioning groove formed in an outer periphery thereof, with the positioning groove extending from an end face of the second end of the engaging member towards but spaced from the first end of the engaging member, with the positioning groove having an end face intermediate the first and second ends of the engaging member along the axis, with a through-hole extending from the end face of the positioning groove through the end face of the first end of the engaging member along the axis, with a positioning block being formed on an inner periphery of the coupling hole of the shank and engaged in the positioning groove, with a fastener extended through the through-hole into the positioning block, with the engaging member being removable from the outer handle after removal of the fastener.

3. The door lock as claimed in claim 2, with the small section including an insert groove formed in an inner periphery thereof, with the insert groove spaced from the bottom wall of the small section along the axis, with the outer spindle further including an insert slot, with an insert being received in the outer spindle and having a portion biased by a resilient member to protrude outward in a radial direction perpendicular to the axis beyond the insert slot into the insert groove allowing joint rotation of the outer spindle, the engaging member, and the outer handle, with the portion of the insert being pressable into the outer spindle to allow detachment of the engaging member and the outer handle from the outer spindle.

4. The door lock as claimed in claim 3, with the end of the outer spindle further including a second cutout, with a second lug formed on the inner periphery of the intermediate section and diametrically opposed to the first lug, with the second lug aligned with and spaced from the insert groove along the axis, with second lug engaged in the second cutout when the outer spindle is engaged in the small section of the engaging member.

5. The door lock as claimed in claim 4, with the large section of the lock core hole of the engaging member including first and second holes in communication with each other, with the ear groove formed in a junction between an inner periphery of the first hole and an inner periphery of the second hole, with the end wall of the large section located in an end of the second hole, with the lock core including a first portion received in the first hole and a second portion received in the second hole, with the cylinder pivotably received in the first portion, with an ear slot formed in an intersection of the first and second portions, with the ear movable through the ear slot between the extended position and the retracted position, with the second portion having an inner end abutting the end wall of the large section.

6. The door lock as claimed in claim 4, with the large section of the lock core hole of the engaging member including first and second holes in communication with each other, with the ear groove formed in a junction between an inner periphery of the first hole and an inner periphery of the second hole, with the end wall of the large section located in an end of the second hole, with the lock core including a first portion received in the first hole and a second portion received in the second hole, with the cylinder pivotably received in the first portion, with an ear slot formed in an intersection of the first and second portions, with the ear movable through the ear slot between the extended position and the retracted position, with the second portion having an inner end abutting the end wall of the large section.

7. The door lock as claimed in claim 6, with the ear groove including two end faces spaced along the axis, with the ear being sandwiched between the end faces of the ear groove when the ear is in the extended position, fixing the lock core in the large section of the lock core hole of the engaging member.

* * * * *